US011454117B2

(12) United States Patent
Sultana et al.

(10) Patent No.: US 11,454,117 B2
(45) Date of Patent: Sep. 27, 2022

(54) ROTOR FOR A CONTRAROTATING TURBINE OF A TURBINE ENGINE

(71) Applicant: SAFRAN AIRCRAFT ENGINES, Paris (FR)

(72) Inventors: Patrick Jean Laurent Sultana, Moissy-Cramayel (FR); Olivier Renon, Moissy-Cramayel (FR); Laurent Cédric Zamai, Moissy-Cramayel (FR); Clément Charles Jérémy Coiffier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/811,341

(22) Filed: Mar. 6, 2020

(65) Prior Publication Data

US 2020/0284150 A1 Sep. 10, 2020

(30) Foreign Application Priority Data

Mar. 8, 2019 (FR) ..... 1902389

(51) Int. Cl.
*F01D 1/24* (2006.01)
*F01D 5/02* (2006.01)

(52) U.S. Cl.
CPC ..... *F01D 1/24* (2013.01); *F01D 5/02* (2013.01); *F05D 2220/30* (2013.01); *F05D 2240/24* (2013.01)

(58) Field of Classification Search
CPC ..... F01D 1/24; F01D 1/26; F01D 5/02; F01D 5/022; F01D 5/03; F01D 5/06; F01D 5/16;

(Continued)

(56) References Cited

U.S. PATENT DOCUMENTS 4,171,930 A * 10/1979 Brisken ..... F01D 5/3015 416/193 A
5,018,941 A * 5/1991 Heurtel ..... F01D 5/32 416/220 R (Continued)

FOREIGN PATENT DOCUMENTS

FR 2660362 A1 10/1991
FR 2660363 A1 10/1991
FR 2942273 A1 8/2010

OTHER PUBLICATIONS

Rapport de Recherche Preliminaire/Opinion Écrite, dated Oct. 30, 2019, issued in corresponding French Application No. 1902389, filed Mar. 8, 2019, 6 pages.

*Primary Examiner* — Courtney D Heinle
*Assistant Examiner* — Danielle M. Christensen
(74) *Attorney, Agent, or Firm* — Christensen O'Connor Johnson Kindness PLLC

(57) ABSTRACT

A rotor for a contrarotating turbine comprising a drum and a blading mounted inside, the drum comprising a hook delimiting a housing having an outer wall and an inner wall, the blading comprising a blade and an outer platform provided with spoiler placed inside the housing, wherein the rotor comprises a foil comprising an elastic inner wing and an outer wing, the outer wing being arranged radially between the spoiler and the outer wall, the inner wing having a first support with the inner wall and a second support with the spoiler, the inner wing being arranged in the housing so as to exert a force on the spoiler so as to press the spoiler against the outer wall via the outer wing.

8 Claims, 5 Drawing Sheets

(58) Field of Classification Search
CPC ... F01D 5/26; F01D 5/303; F01D 5/10; F01D 25/04; F01D 25/06; F01D 25/243; F01D 25/28; F05D 2240/90; F05D 2250/44; F05D 2250/90; F05D 2260/38; F05D 2260/96
See application file for complete search history.

(56) References Cited

U.S. PATENT DOCUMENTS

| | | | | |
|---|---|---|---|---|
| 5,131,813 | A | 7/1992 | Przytulski et al. | |
| 5,131,814 | A | 7/1992 | Przytulski et al. | |
| 5,307,622 | A | 5/1994 | Ciokajlo et al. | |
| 5,333,995 | A | 8/1994 | Jacobs et al. | |
| 8,667,777 | B2 | 3/2014 | Gallet | |
| 9,080,463 | B2 * | 7/2015 | Denece | F01D 11/08 |
| 9,212,564 | B2 * | 12/2015 | Langlois | F01D 9/042 |
| 10,138,734 | B2 * | 11/2018 | Jaureguiberry | F01D 11/005 |
| 2004/0086377 | A1 | 5/2004 | Proctor et al. | |

* cited by examiner

[Fig. 1]
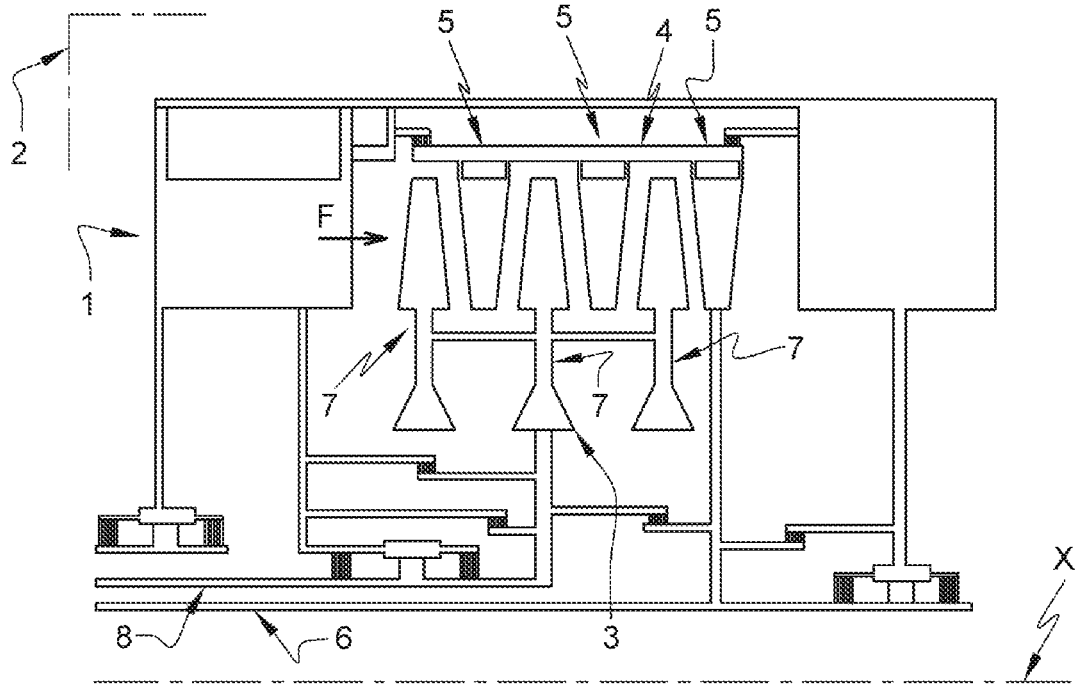

[Fig. 2]
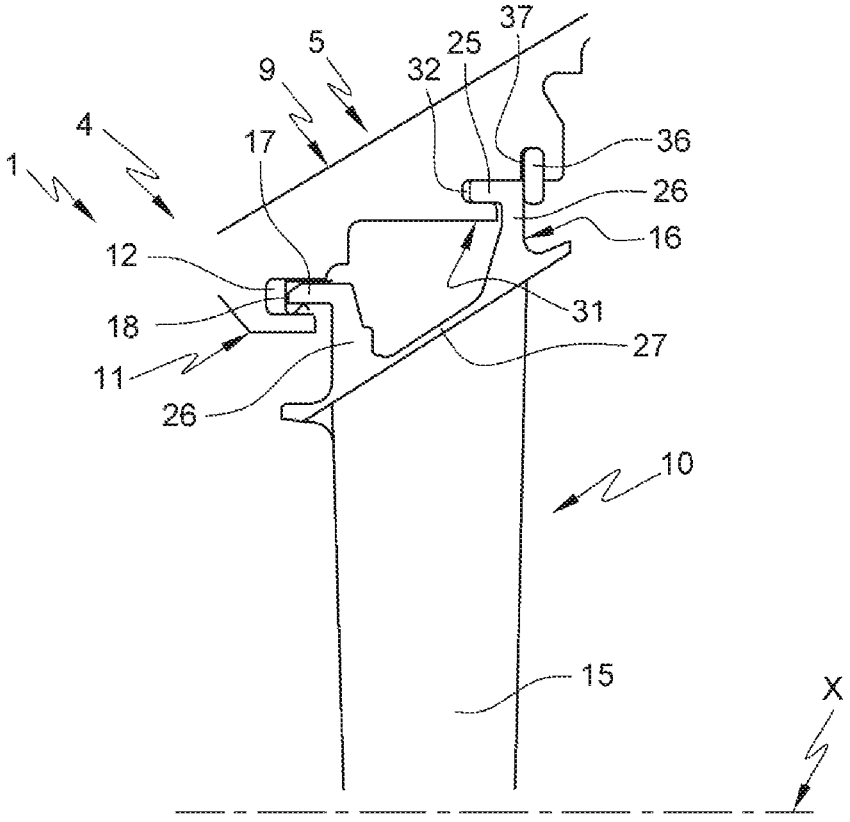

[Fig. 3]
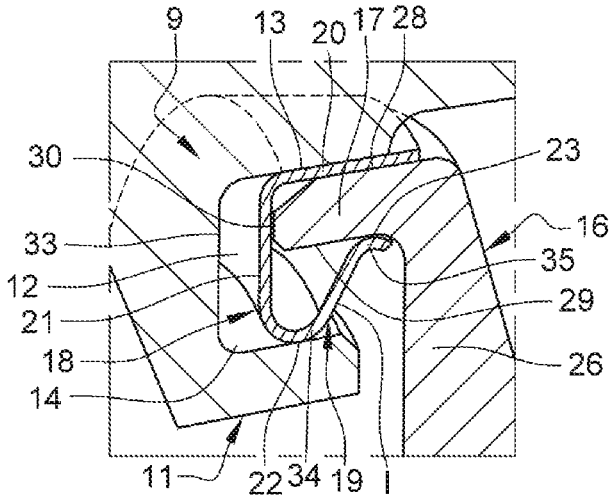
[Fig. 4]
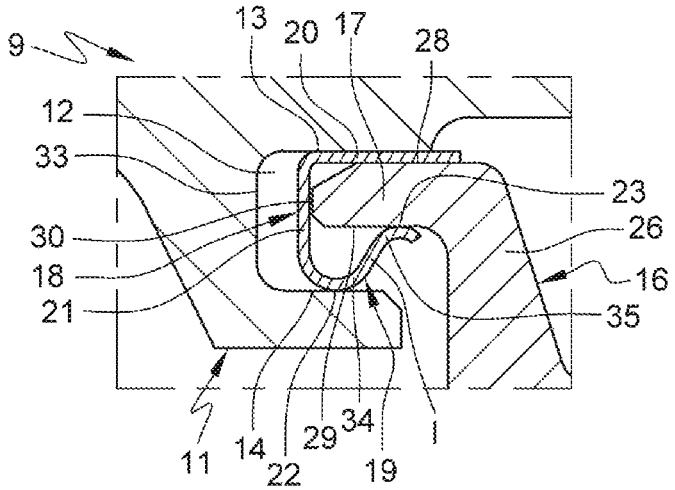

[Fig. 5]
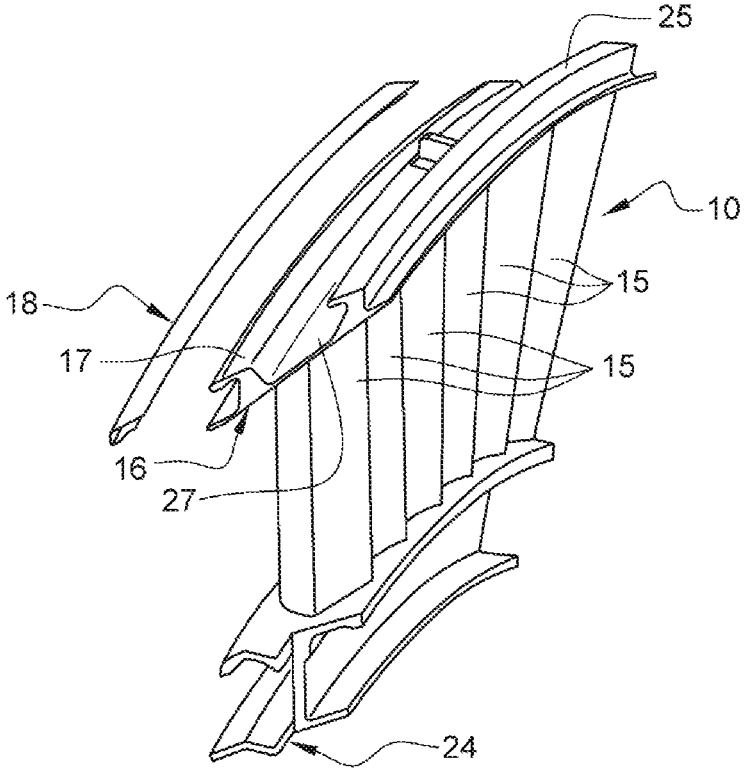

[Fig. 6]
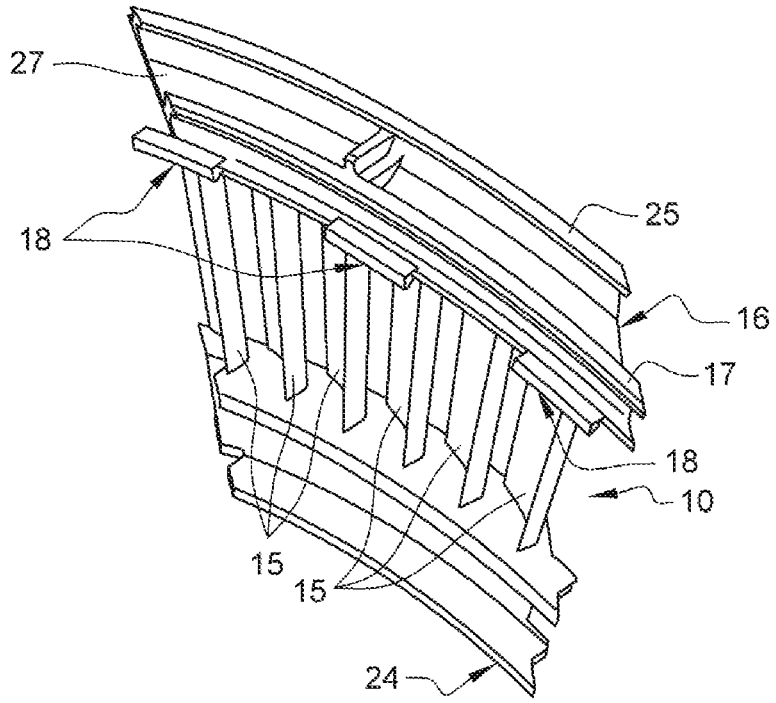
[Fig. 7]
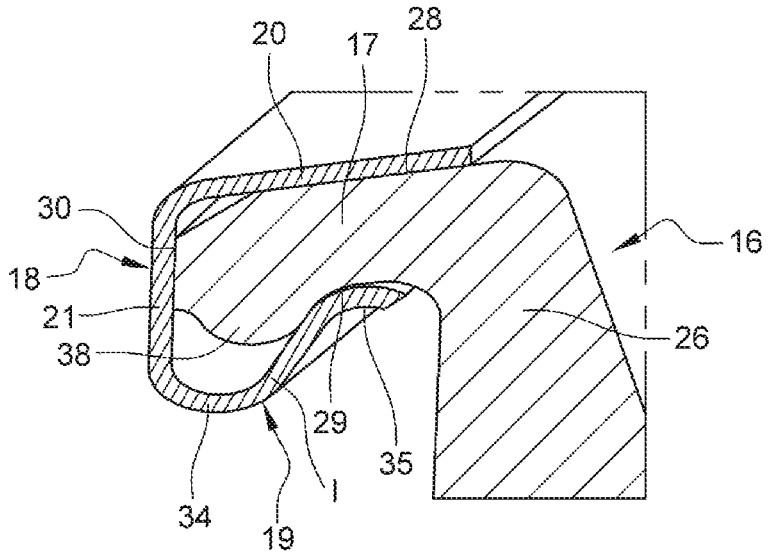

ROTOR FOR A CONTRAROTATING TURBINE OF A TURBINE ENGINE

TECHNICAL FIELD

Embodiments of the present disclosure relate to the general field of rotors for a contrarotating turbine of a turbine engine.

BACKGROUND

It is known from document FR-A1-2942273 in the name of the applicant to install a contrarotating turbine within a turbine engine. Such a contrarotating turbine comprises, in particular, an inner rotor configured to rotate in a first direction of rotation and an outer rotor configured to rotate in a second direction of rotation which is opposite to the first direction of rotation. The inner and outer rotors are rotatable about the longitudinal axis of the turbine engine.

Each of the rotors generally comprises a plurality of wheels linked in rotation to one another. Each wheel comprises a disc and a blading comprising one or more blades. By definition, a blading of a wheel of the outer rotor is fixed internally on the corresponding disc (more commonly termed "drum") and the blading of a wheel of the inner rotor is fixed externally on the corresponding disc. The wheels of the outer rotor are axially inserted between the wheels of the inner rotor.

Document U.S. Pat. No. 5,307,622 describes an example of mounting a blading on the disc of a wheel of the outer rotor. The blading comprises several blades radially delimited by an inner platform and an outer platform. The blading is positioned on the disc via an upstream spoiler and a downstream spoiler made in the outer platform. The upstream and downstream spoilers are respectively configured to be attached to an upstream hook and a downstream hook made in a corresponding disc. The blading is maintained in position by a screw of which the head is bearing on the corresponding disc and the threaded portion engages with a tapped hole formed in the outer platform.

Such a mounting does not enable any degree of freedom and thus has the advantage of immobilising the blading during different operating regimes of the turbine engine. Indeed, the screw here allows to remove the current mounting clearances which originate from residual movements during the operation of the turbine engine.

However, such a mounting significantly stresses the discs of the different wheels of the outer rotor. Indeed, the aerodynamic and centrifugal forces being exerted on the blading are mechanically taken up by the disc. Furthermore, the vibratory stresses being exerted on the blading are also taken up by the disc without prior damping. These vibratory stresses are maximal when the blading resonates.

Such a mounting therefore involves a consequent sizing of the different discs, at the expense, in particular, of the mass of the discs and more generally, of the contrarotating turbine.

The aim of the present disclosure is thus to provide an improved mounting allowing to overcome the abovementioned disadvantages or others.

SUMMARY

The disclosure thus provides a rotor for a contrarotating turbine of a turbine engine. In an embodiment, the rotor comprises a drum capable of being rotated about a longitudinal axis X and a blading mounted radially inside the drum.

In an embodiment, the drum comprises a first inner hook delimiting a first open housing, the housing having an outer wall and an inner wall. In an embodiment, the blading comprises at least one blade and an outer platform provided with a first spoiler placed inside the first housing. In an embodiment, the rotor comprises at least one foil fixed on the first spoiler, the foil comprising an elastic inner wing and an outer wing connected to one another via a core. In an embodiment, the outer wing is arranged radially between the first spoiler and the outer wall. The inner wing has a first support with the inner wall and second support with the first spoiler, the inner wing being arranged in the first housing so as to exert a force on the first spoiler at the level of the second support so as to press the first spoiler against the outer wall via the outer wing.

The foil thus allows to press the first spoiler against the outer wall in the operating regimes where the centrifugal force is not sufficient to cope with the aerodynamic forces undergone by the blading, for example when the rotation speed of the rotor is less than a predetermined threshold.

Furthermore, the foil allows to damp the blading and thus to reduce the amplitude of the forces and the vibrations transmitted to the drum.

Such a mounting thus significantly reduces the wear, benefiting the lifespan of the rotor.

The rotor according to embodiments of the disclosure can comprise one or more of the features and/or following steps, taken individually from one another or in combination with one another:

- the outer platform of the blading comprises a second spoiler separate from the first spoiler and arranged axially downstream from the first spoiler, the second spoiler being placed inside a second housing delimited by a second hook inside the drum;
- the first and second spoilers are each oriented axially downstream to upstream, the first and second housings being axially opened downstream;
- the foil is clipped on the first spoiler;
- the first spoiler comprises a protrusion protruding from an inner face, the protrusion being axially arranged between the core and the second support;
- the foil is a ring or a ring sector;
- the inner wing comprises a first curved section connected directly to the core and a second curved section connected to the first section via an inflection point I, the first and second supports being arranged respectively at the level of the first section and of the second section;
- the first section is concave and the second section is convex.

The present disclosure also relates to a contrarotating turbine comprising a rotor such as described above.

The present disclosure also relates to a turbine engine comprising a contrarotating turbine such as described above.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

FIG. 1 is a schematic, axial cross-sectional view of a representative contrarotating turbine comprising an inner rotor and an outer rotor which are contrarotating;

FIG. 2 is a detailed, schematic, axial cross-sectional view illustrating the assembly of a bladed sector on a drum of the outer rotor according to an embodiment of the present disclosure;

FIG. 3 is a detailed, perspective view illustrating the assembly of an upstream spoiler of the bladed sector on the drum via a foil according to an embodiment of the present disclosure;

FIG. 4 is a detailed, axial cross-sectional view illustrating the assembly of the upstream spoiler on the drum via the foil according to an embodiment of the present disclosure;

FIG. 5 is an exploded, perspective view of the bladed sector and of the foil illustrated in FIGS. 2 to 4;

FIG. 6 is an exploded, perspective view illustrating another embodiment of the present disclosure;

FIG. 7 is a detailed, perspective view illustrating another embodiment of the present disclosure.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In FIG. 1, a contrarotating turbine 1 of a turbine engine 2 is schematically represented, the contrarotating turbine 1 comprising an inner rotor 3 configured to rotate in a first direction of rotation and an outer rotor 4 configured to rotate in a second rotation of direction which is opposite to the first direction of rotation. The inner and outer rotors 3, 4 of the turbine 1 are rotatable about the longitudinal axis X of the turbine engine 2.

Conventionally, in the present application, by "axial" or "axially", this means any direction parallel with the axis X, and by "radial" or "radially", this means any direction perpendicular to the axis X. Likewise, in the present application, the terms "inner", "outer", "interior" or "exterior" are defined with respect to the longitudinal axis X of the turbine engine 2.

The turbine 1 is arranged axially directly downstream from a combustion chamber or directly downstream from a high-pressure turbine which is itself arranged downstream from combustion chamber.

Such as illustrated in FIG. 1, the outer rotor 4 comprises three wheels 5 spaced axially from one another, the three wheels 5 being linked in rotation and connected to a first shaft 6. In the same manner as the outer rotor 4, the inner rotor 3 comprises three wheels 7 spaced axially from one another, the three mobile wheels 7 being linked in rotation and connected to a second shaft 8 which surrounds here the first shaft 6. The wheels 5 of the outer rotor 4 are inserted between the wheels 7 of the inner rotor 3.

An exhaust gas flow F coming from the combustion chamber therefore passes successively through a wheel 7 of the inner rotor 3, then a wheel 5 of the outer rotor 4.

In the present application, the terms "upstream" and "downstream" are defined with respect to the direction of flow of the exhaust gas flow F in the turbine 1.

A wheel 5 of the outer rotor 4 comprises a drum 9 capable of being rotated about the longitudinal axis X and a blading 10 mounted radially inside the drum 9. The drum 9 comprises a first inner hook 11 delimiting a first open housing 12, the housing 12 having an outer wall 13 and an inner wall 14. The blading 10 comprises at least one blade 15 and an outer platform 16 provided with a first spoiler 17 placed inside the first housing 12.

According to an embodiment of the disclosure, the wheel 5 comprises at least one foil 18 fixed on the first spoiler 17. The foil 18 comprises an elastic inner wing 19 and an outer wing 20 connected to one another via a core 21. The outer wing 20 is arranged radially between the first spoiler 17 and the outer wall 13. The inner wing 19 has a first support 22 with the inner wall 14 and a second support 23 with the first spoiler 17. The inner wing 19 is arranged in the first housing 12 so as to exert a force on the first spoiler 17 at the level of the second support 23 so as to press the first spoiler 17 against the outer wall 13 via the outer wing 20.

According to the embodiments illustrated in the FIGURES, the blading 10 of each of the wheels 5 of the outer rotor 4 comprises an annular row of bladed sectors arranged circumferentially end-to-end.

In an embodiment, the blading of each of the wheels (or of one of the wheels) of the outer rotor comprises a single annular ring.

More specifically, such as illustrated in FIGS. 5 and 6, each bladed sector comprises here six regularly distributed aerodynamic blades 15. Each of the blades 15 extends radially with respect to the axis X. The blades 15 of the same bladed sector are delimited by a common outer platform 16 and a common inner platform 24.

The outer platform 16 of a bladed sector comprises a first upstream spoiler 17 (below termed upstream spoiler) and a second downstream spoiler 25 (below termed downstream spoiler) axially separate from one another. The upstream and downstream spoilers 17, 25 extend here circumferentially in the form of a ring sector. The upstream and downstream spoilers 17, 25 extend here circumferentially over the total length of the sector. The upstream and downstream spoilers 17, 25 are each oriented axially downstream to upstream from a radially outer end of a collar 26, each collar 26 protruding radially outwards from a plate 27 of the outer platform 16.

In an embodiment, the upstream and downstream spoilers could be, for example, oriented axially upstream to downstream.

In the case where the blading comprises a single annular ring, the upstream and downstream spoilers extend circumferentially in the form of a ring.

Each of the upstream and downstream spoilers 17, 25 has, in cross-section, a substantially rectangular profile and is thus delimited by an outer face 28 and an inner face 29 connected to one another by an upstream face 30. The outer and inner faces 28, 29 are coaxial, the upstream face 30 being flat.

According to some embodiments, the bladed sector is obtained in one piece, and in other words, the inner and outer platforms 16, 24 are integrally formed with the blades 15. In another embodiment, the bladed sector could be obtained via the assembly of different subassemblies. As an example, a spoiler could be integrally formed with a collar so as to form a subassembly fixed on the plate of the outer platform.

According to some embodiments, the drum 9 of a wheel 5 of the outer rotor 4 comprises a first upstream inner hook 11 (below termed upstream hook) and a second downstream inner hook 31 (below termed downstream hook) axially separated from one another. The upstream and downstream hooks 11, 31 form respectively a first upstream housing 12

(below termed upstream housing) and a second downstream housing 32 (below termed downstream housing).

More specifically, the upstream and downstream hooks 11, 31 are annular. Each of the hooks 11, 31 has, in the cross-section, a substantially C-shaped profile. The housings 12, 32 are open downstream. Each of the upstream and downstream housings 12, 32 is thus delimited by an outer wall 13 and an inner wall 14 connected to one another by an upstream wall 33. The outer and inner walls 13, 14 are more specifically coaxial, the upstream wall 33 being flat.

In the case where the blading of a wheel of the outer rotor comprises an annular row of bladed sectors arranged circumferentially end-to-end, each bladed sector can comprise a single foil being presented in the form of a ring sector, or several foils each being presented in the form of a ring sector and distributed circumferentially regularly.

In the case where the blading of a wheel of the outer rotor comprises a single annular ring, the blading can comprise a single foil being presented in the form of a ring, or several foils each being presented in the form of a ring sector and distributed circumferentially regularly.

According to some embodiments, a foil 18 can be annular or a ring sector. A foil 18 has, in the cross-section, a substantially C-shaped or U-shaped profile, of which the opening opens downstream. The inner and outer wings 19, 20 are thus located facing one another.

More specifically, the outer wing 20 can be annular or a ring sector. The core 21 is flat and can be annular or a ring sector. The inner wing 19 has, in the cross-section, a crimped profile. More specifically, the inner wing 19 comprises a first concave section 34 connected directly to the core 21 and a second convex section 35 connected to the first section 34 via an inflection point I. The concavity/convexity of the inner wing 19 is determined according to the radial direction oriented from the outside towards the interior. The second section 35 has a greater curvature than the first section 34. With respect to the first section 34, the second section 35 is radially offset in the direction of the outer wing 20. The inflection point I is located radially between the first support 22 and the second support 23.

The first support 22 between the inner wing 19 and the inner wall 14 is located at the level of the first section 34. The second support 23 between the inner wing 19 and the upstream spoiler 17 is located at the level of the second section 35. The first and second supports 22, 23 are linear and annular. The first support 22 is arranged at a radially inner end of the foil 18. The second support 23 is located radially substantially halfway up the core 21.

The inner wing 19 is elastically deformed between an idle state in which no outer force is applied on the foil and a charged state in which opposite outer forces are applied on the inner and outer wings 19, 20 of the foil 18 so as to move them closer to one another.

The foil 18 goes from an idle state to a charged state, during the introduction of the foil 18 in the upstream housing 12. At the end of the mounting of the foil 18 in the upstream housing 12, the inner wing 19 exerts a prestressing (or preload) force on the upstream spoiler 17 at the level of the second support point 23, this prestressing force being oriented radially from the inside to the outside. The prestressing force is directly linked to the restoring force exerted by the inner wing 19 on the inner wall 14 at the level of the first support 22, this restoring force being oriented radially from the outside to the inside.

Advantageously, the foil is made of a heat-resistant material, for example, a cobalt and/or nickel-based alloy.

According to some embodiments, each sector is positioned on the drum 9 by introducing respectively the upstream and downstream spoilers 17, 25 in the upstream and downstream housings 12, 32 of the drum 9, the foil(s) 18 being fixed beforehand on the upstream spoiler 17 of the corresponding sector.

Thus, in the mounted position, the outer wing 20 is located radially between the outer face 28 and the outer wall 13. The outer wing 20 is pressed against the outer wall 13 under the action of the upstream spoiler 17 which is itself subjected to the prestressing force generated by the elastic deformation of the inner wing 19 and/or to the centrifugal force.

The core 21 is located axially between the upstream wall 33 and the upstream face 30, the core 21 could be flush with the upstream face 30 or bearing on the upstream face 30.

The inner wing 19 is located radially between the inner face 29 and the inner wall 14. The inner wing 19 exerts a prestressing force on the upstream spoiler 17 at the level of the second support 23 so as to press the upstream spoiler 17 against the outer wall 13 via the outer wing 20.

The prestressing force is predetermined so as to press the upstream spoiler 17 against the outer wall 13 in the operating regimes where the centrifugal force is not sufficient to do it (namely when the aerodynamic forces are exerted on the blading are greater than the centrifugal force), in particular, when the rotation speed of the outer rotor 4 is less than a predetermined threshold. The foils 18 thus allow to immobilise the sectors, and in other words, to avoid residual movements (such as the pivoting of the sectors), in particular when the rotation speed of the outer rotor 4 is less than the predetermined threshold.

Furthermore, the prestressing force is predetermined so as to damp the bladed sectors and thus to reduce the amplitude of the forces and of the vibrations transmitted to the drum 9. The foil(s) 18 thus form(s) a damper for the corresponding sector.

To adjust the prestressing force, it is in particular possible to modify the dimensional or geometric features of the inner wing 19 and/or the material of the inner wing 19.

In the mounted position, the downstream spoiler 25 is mounted in the downstream housing 32 with a radial clearance. Thus, according to the operating regime, the inner face 29 is flush with the inner wall 14 or bearing on the inner wall 14 and the outer face 28 is flush with the outer wall 13 or bearing on the outer wall 13.

In the mounted position, such as illustrated in FIG. 2, each sector is maintained axially in position by at least one stop ring 36 partially housed in an annular groove 37 made in the drum 9. The stop ring 36 is partially housed in the groove 37 and partially axially bearing against a downstream surface of the collar 26 associated with the downstream spoiler 25.

According to the embodiments illustrated in FIGS. 2 to 4, each bladed sector comprises a single foil, in other words, the foil 18 extends circumferentially over the total length of the upstream spoiler 17.

According to the embodiment illustrated in FIG. 6, each bladed sector comprises several foils 18 distributed circumferentially regularly. In other words, each foil 18 extends only over a circumferential portion of the upstream spoiler 17. Advantageously, each sector can thus comprise between two and ten foils 18.

According to the embodiments illustrated in FIGS. 2 to 4, the foil 18 is clipped on the upstream spoiler 17. In other words, during mounting of the foil 18 on the upstream spoiler 17, the inner wing 19 is elastically deformed such that the inner wing 19 exerts a maintaining force on the upstream spoiler 17 at the level of the second support point 23, this maintaining force being oriented radially from inside to outside. This maintaining force allows to maintain the foil 18 on the sector during mounting of the sector on the drum 9.

According to an embodiment illustrated in FIG. 7, the upstream spoiler 17 comprises a protrusion 38 protruding from the inner face 29 thereof. The protrusion 38 is axially arranged between the core 21 and the second support 23. During mounting of the foil 18 on the upstream spoiler 17, the inner wing 19 is elastically deformed so as to increase the distance between the inner wing 19 and the outer wing 20, and thus allow the passage of the protrusion 38. At the end of the mounting of the foil 18, the foil 18 is thus blocked axially by the protrusion 38.

Advantageously, the protrusion 38 has, in the cross-section, a rounded profile, in order to facilitate mounting of the foil 18 on the upstream spoiler 17.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A rotor for a contrarotating turbine of a turbine engine, comprising:

a drum capable of being rotated about a longitudinal axis and a blading mounted radially inside the drum, the drum comprising a first inner hook delimiting a first open housing, the first open housing having an outer wall and an inner wall, the blading comprising at least one blade and an outer platform provided with a first spoiler placed inside said first open housing; and at least one foil fixed on the first spoiler, said foil comprising an elastic inner wing and an outer wing connected to one another via a core, said outer wing being arranged radially between the first spoiler and said outer wall, said inner wing having a first support with said inner wall and a second support with the first spoiler, said inner wing being arranged in the first housing so as to exert a force on the first spoiler at the level of said second support so as to press said first spoiler against said outer wall via said outer wing, wherein the entirety of said outer wing is straight and said inner wing comprises a first concave section connected directly to said core and a second convex section connected to said first concave section via an inflection point, said first and second supports being arranged respectively at the level of said first concave section and of said second convex section.

2. The rotor according to claim 1, wherein said outer platform of the blading comprises a second spoiler distant from said first spoiler and arranged axially downstream from said first spoiler, said second spoiler being placed inside a second housing delimited by a second inner hook of the drum.

3. The rotor according to claim 2, wherein the first and second spoilers are each oriented axially downstream to upstream, said first and second housings being open axially downstream.

4. The rotor according to claim 1, wherein the foil is clipped on said first spoiler.

5. The rotor according to claim 1, wherein the first spoiler comprises a protrusion protruding from an inner face of the first spoiler, said protrusion being axially arranged between said core and said second support, the inner face being opposite the inner wall.

6. The rotor according to claim 1, wherein the foil is a ring or a ring sector.

7. A contrarotating turbine comprising the rotor according to claim 1.

8. A turbine engine comprising the contrarotating turbine according to claim 7.

* * * * *